US006530190B2

(12) United States Patent
Conachen

(10) Patent No.: US 6,530,190 B2
(45) Date of Patent: Mar. 11, 2003

(54) SNAP-FIT WEATHERSTRIPPING COVER FOR TILT JAMB LINERS

(76) Inventor: James A. Conachen, 108 Wadsworth Rd., Duxbury, MA (US) 02332

( * ) Notice: Subject to any disclaimer, the term of this patent is extended or adjusted under 35 U.S.C. 154(b) by 33 days.

(21) Appl. No.: 09/887,822

(22) Filed: Jun. 22, 2001

(65) Prior Publication Data

US 2002/0194810 A1 Dec. 26, 2002

(51) Int. Cl.[7] ..... E05D 13/00

(52) U.S. Cl. ..... 52/718.04; 52/204.5; 49/483.1; 49/489.1; 49/492.1

(58) Field of Search ..... 52/718.04, 204.5; 49/483.1, 489.1, 492.1

(56) References Cited

U.S. PATENT DOCUMENTS 3,325,945 A * 6/1967 Beasley et al.
4,364,199 A * 12/1982 Johnson et al.
4,464,864 A * 8/1984 Yackiw ..... 49/404
5,159,794 A * 11/1992 Habbersett et al.
5,254,972 A * 10/1993 Cordio
5,526,608 A * 6/1996 Stark
5,934,031 A * 8/1999 de Normand ..... 52/204.5
6,026,617 A * 2/2000 Stark ..... 52/204.5 X
6,041,550 A * 3/2000 Tix
6,305,126 B1 * 10/2001 Hendrickson et al.

* cited by examiner

*Primary Examiner*—Robert W. Gibson, Jr.
(74) *Attorney, Agent, or Firm*—Donald W. Meeker

(57) ABSTRACT

Extruded or molded plastic covers snap fit into the jamb liner slots over the lower jamb liners. Replaceable brush weatherstrips on the edge contact the lower window sash. Upper foam pads engage the upper window sash and press the upper sash against the window frame. The smooth outer face of the covers may be painted. A T-shaped back rail inserts in a back jamb liner slot.

14 Claims, 1 Drawing Sheet

SNAP-FIT WEATHERSTRIPPING COVER FOR TILT JAMB LINERS

BACKGROUND OF THE INVENTION

1. Field of the Invention

The present invention relates to weatherstrips for sash-type windows and in particular to a snap-fit adjustable weatherstripping cover for tilt jamb liners.

2. Description of the Prior Art

Tilt jamb liners for wood windows leak air on the side of the sash over time. The foam backing on the tilt jamb liners breaks down, the pins push the sash away from the jam liner, and the jamb boards move away from the window over time. The bottom sash is the worst.

Prior art devices for weatherstripping primarily address built-in weatherstripping solutions for windows. But as indicated above, the weatherstripping breaks down over time.

U.S. Pat. No. 2,108,450, issued Feb. 15, 1938 to Schlegel, shows in FIG. 2 an L-shaped bracket screwed to a guide on a side frame with a pile-type weather strip on a perpendicularly extending leg of the bracket in contact with the window sash.

U.S. Pat. No. 2,040,133, issued Mar. 12, 1936 to Harnly, provides an elongated metal strip which screws to a flange parallel to the window sash and has a groove holding a weather strip which protrudes perpendicularly from the metal strip in contact with the window sash.

U.S. Pat. No. 4,604,831, issued Aug. 12, 1986 to Tunnicliffe et al., claims sliding sash windows with pile weatherstripping held in plastic inserts pressed into grooves in a box frame molding and a staff bead providing a weather seal both inside and outside the windows.

U.S. Pat. No. 2,132,748, issued Oct. 11, 1938 to Mohun, describes a window having a head stop with a notch in which is inserted a fiber weatherstrip which contacts the window sash.

There is a need for a retrofit weatherstripping means to mount on existing windows after the built-in weatherstripping breaks down.

SUMMARY OF THE INVENTION

An object of the present invention is to provide a retrofit tilt jamb liner weatherstripping cover to apply to existing tilt jamb liners when the built-in foam stripping breaks down, thereby sealing the window sash inexpensively without the need to replace the entire jamb liner.

Another object of the present invention is to provide a snap-fit tilt jamb liner weatherstripping cover having a flexible clip or keyway which snaps into and out of the jamb liner slot for easy installation with no tools or fasteners required to seal the window sash in cold weather and easy removal to enable opening and tilting of the window in warm weather.

One more object of the present invention is to provide an adjustable tilt jamb liner weatherstripping cover having replaceable brush weatherstripping of various desired lengths insertable in a slot along the length of the snap-fit weatherstripping cover and contacting the length of the lower window sash to prevent air and water infiltration around the window sash.

An additional object of the present invention is to provide a tilt jamb liner weatherstripping cover fabricated of various lengths to fit precisely along the length of the lower sash and support the upper sash maintaining it against the top weather strip.

A further object of the present invention is to provide a tilt jamb liner weatherstripping cover having a piece of foam on a top end to prevent air and water infiltration between the tilt jamb liner weatherstripping cover and the top sash.

An added object of the present invention is to provide a tilt jamb liner weatherstripping cover which is easy and inexpensive to manufacture by fabricating it from extruded or molded plastic.

A contributory object of the present invention is to provide a tilt jamb liner weatherstripping cover having an outer face which is paintable to match the sash color or other decor of the house.

An ensuing object of the present invention is to provide a tilt jamb liner weatherstripping cover having a width which matches the width of the jamb liner and covers the jamb liner for a smooth improved appearance, preservation of the jamb liner by shielding it from the elements barring ice build-up in the jamb liner slot, and making maintenance easier by preventing debris from entering the jamb liner slot.

An ancillary object of the present invention is to provide a smooth outer face on the tilt jamb liner weatherstripping cover to prevent mold which normally forms in the slotted jamb liner.

A still further object of the present invention is to provide a tilt jamb liner weatherstripping cover which seal the end of the meeting rail against rain and air infiltration.

Yet another object of the present invention is to provide a new T-shaped back rail which slides into the narrow back slot of the jamb liner to prevent air and water infiltration behind the jamb liner where the foam has deteriorated.

In brief an elongated strip equal in length to the distance between the sill to the bottom of the top sash is fabricated preferably of extruded or molded plastic or of wood or other stiff non-porous material, formed with a slot along one long edge and a protruding clip or keyway to fit in the jamb liner slot along at least a portion of an inner face of the strip, at least adjacent to each end but preferably along the entire length.

A weatherstrip brush, or other resilient weatherstripping means such as foam, of a desired depth is friction fit in the edge slot along its entire length. A foam pad, or other resilient weatherstripping means, is attached to a top end of the strip by an adhesive or other attaching means.

The outer face of the strip is smooth in a curved or flat shape and may be painted to match the sashes or frames or other decor of the building.

A back rail, having a T-shaped cross-section, is formed of an elongated strip of extruded or molded plastic fabricated the length of the jamb liner and is inserted in the narrow back slot of the jamb liner to prevent air and water infiltration behind the jamb liner where the foam has deteriorated.

An advantage of the present invention is that it may be used as an inexpensive and easily applied means, with no tools or fasteners required, to stop drafts and leaks around window sills and jamb liners without the need to replace the entire jamb liner.

Another advantage of the present invention is that it covers the jamb liner for more aesthetic appeal, easier maintenance, and prolonged life of the jamb liner.

An additional advantage of the present invention is that it holds the upper sash against the top weather strip, eliminating the need for additional insulation.

One more advantage of the present invention is that it provides aesthetic appeal as well as functionality.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 1:
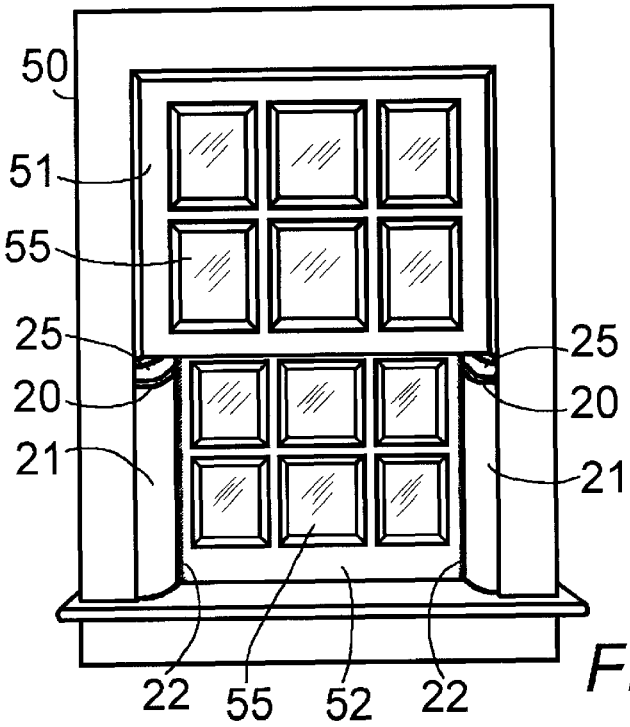
FIG. 1 is a front perspective view of a window employing the invention positioned on both sides of the tilt jam liner against the bottom sash.
Figure 2:
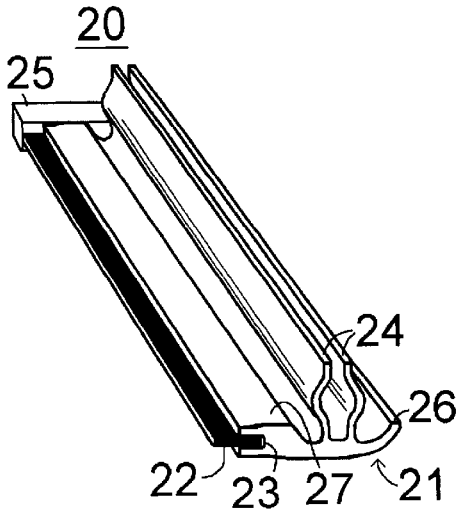
FIG. 2 is a perspective view of the invention.
Figure 3:
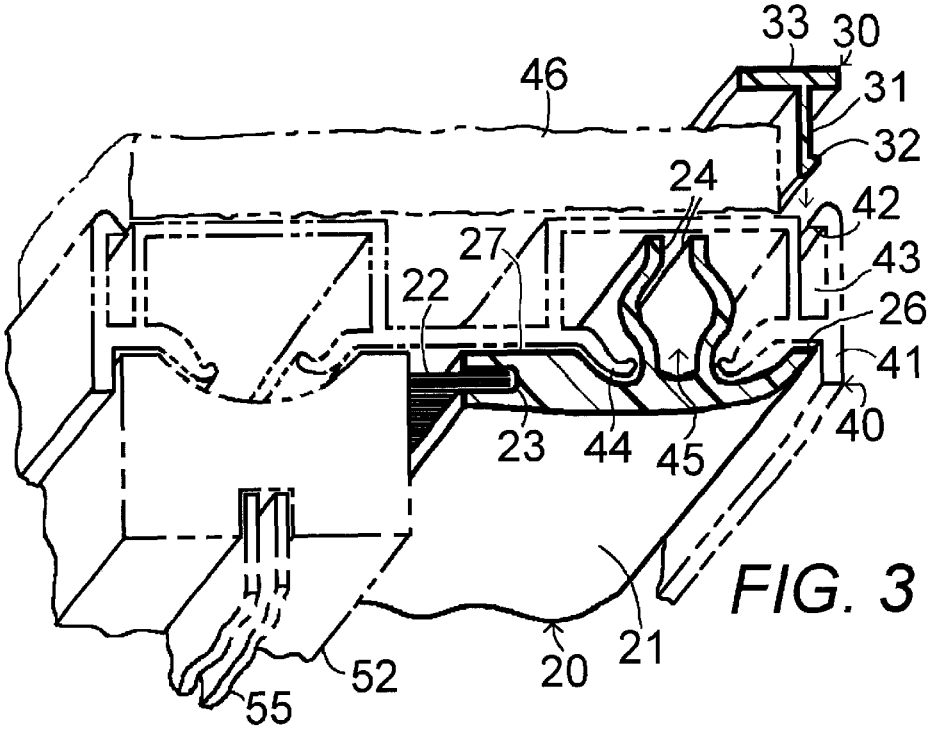
FIG. 3 is a partial perspective view with a horizontal cross-sectional cut of the invention snap fit into the tilt jam liner.

In FIGS. 1, 2, and 3, the invention comprises a weatherstripping cover 20 device for tilt jamb liners 40 having slots 45 to engage sliding sash windows 51 and 52 with window panes 55 in a window frame 50.

The elongated tilt jamb liner weatherstripping cover 20 is sized to cover one section of a tilt jamb liner 40 adjacent to a sash, preferably the bottom sash 52. The jamb liner weatherstripping cover 20 has an inner face 27 contacting the tilt jamb liner 40 and an exposed outer face 21 and an inner edge having a weatherstripping means 22 contacting the sash 52 and an outer edge 26 away from the sash 52. The jamb liner weatherstripping cover 20 is preferably fabricated of a weather-resistant plastic, either extruded or molded, or could be made of aluminum, wood, or other material.

The weatherstripping means 22 secured to the tilt jamb liner weatherstripping cover 20 along the inner edge is capable of contacting the sash 52 along its entire exposed height to prevent the passage of air and moisture therebetween.

A means for removably attaching the tilt jamb liner weatherstripping cover to the tilt jamb liner comprises a flexible clip 24 on the inner face 27 of the tilt jamb liner weatherstripping cover 20, the flexible clip capable of engaging and disengaging the jamb liner slot 45 with a snap fit.

The flexible clip comprises a double key way clip 24 running the entire length of the tilt jamb liner weatherstripping cover 20, each side of the double key way clip having a curved elongated flexible member 24 capable of bending inwardly to slip past one edge 44 of the jamb liner slot and capable snapping back to engage the one edge of the jamb liner slot 44 to secure the jamb liner weatherstripping cover 20 in place with a snap fit, and further capable of bending inwardly to slip past one edge of the jamb liner slot 44 upon being pulled away from the jamb liner slot for removal. The jamb liner weatherstripping cover 20 may be easily installed and removed without the need for tools or other fastening means.

The inner edge of the jamb liner weatherstripping cover is further provided with a weatherstripping slot 23 in the inner edge running the length of the device and the weatherstripping means comprises a weatherstripping brush 22 of a desired bristle length friction fit in the weatherstripping slot, the weatherstripping brush 22 being capable of pressing against the sash 52, is seen in FIG. 3, to form a seal and the weatherstripping brush being capable of removal and replacement if the brush is worn or if a different size brush is desirable. Other types of weatherstripping means, such as foam or rubber, could also be used in a similar fashion.

The jamb liner weatherstripping cover 20 is equal in length to the exposed portion of a lower sash 52 and is capable of contacting the exposed portion of the lower sash and sealing it while a bottom end of the jamb liner weatherstripping cover is capable of resting on the bottom of the window frame 50 and a top end of the jamb liner is capable of supporting an upper sash 51 pressed firmly against the top of the window frame in a sealed relationship.

A resilient weatherstripping means, such as a foam pad 25 or other resilient water and air-resistant material, is attached to the top of the jamb liner weatherstripping cover 20, by adhesive or other securing means, in a sealed relationship between the upper sash 51 and the jamb liner weatherstripping cover 20 against air and water infiltration.

The outer face 21 of the jamb liner weatherstripping cover 20 is a smooth surface, curved or flat, capable of resisting mold, which often builds up in the uncovered jamb liner. The outer face 21 of the jamb liner weatherstripping cover is capable of being painted or coated in any desired color to match the window frame, sash, or other decor of the building.

In FIG. 3, the tilt jamb liner 40 is provided with a protruding tab 41 along an outer side and the outer edge of the tilt jamb liner weatherstripping cover is provided with a straight edge 26 capable of engaging and sealing against the protruding tab to cover the jamb liner and prevent leakage of air or water underneath the weatherstripping cover 20.

The tilt jamb liner 20 is provided with a recessed slit 43 along an inner side edge and the device further comprises a T-shaped back rail 30, fabricated of extruded or molded plastic or other material, capable of being inserted in the recessed slit 43 in a sealed relationship. The recessed slit 43 is provided with a protruding lip 42 along its opening and the T-shaped back rail 30 is provided with a flat face 33 and a protruding tab 31 having a mating protruding lip 32 along its length so that the protruding lips engage for a sealed snap fit to prevent the leakage of air or water behind the jamb liner past the deteriorating foam 46.

In use, the jamb liner weatherstripping cover 20 is installed over the jamb liner 40 on each side of the window frame 50 with the weatherstripping brush 22 against the bottom sash 52, as seen in FIG. 1. The two jamb liner weatherstripping covers 20 rest on the bottom of the window frame and press the upper sash 51 against the top of the window frame to prevent leakage of air and water around the upper sash. A foam pad 25 or other weatherstripping material between the weatherstripping cover 20 and the upper sash 51 further prevents air and water leakage therebetween. The present invention provides an inexpensive and easily installed (easily removed) means for more comfort and energy efficiency within a building which has been experiencing air and or water leakage due to the deterioration or separation of the existing jamb liners.

It is understood that the preceding description is given merely by way of illustration and not in limitation of the invention and that various modifications may be made thereto without departing from the spirit of the invention as claimed.

What is claimed is:

1. A weatherstripping cover device for tilt jamb liners having slots to engage sliding sash windows in a window frame, the device comprising:

an elongated tilt jamb liner weatherstripping cover sized to cover one section of a tilt jamb liner adjacent to a sash, the jamb liner weatherstripping cover having an inner face contacting the tilt jamb liner and an exposed outer face and an inner edge contacting the sash and an outer edge away from the sash, a weatherstripping means secured to the tilt jamb liner weatherstripping cover along the inner edge, the weatherstripping means capable of contacting the sash along its entire exposed height to prevent the passage of air and moisture therebetween;

a means for removably attaching the tilt jamb liner weatherstripping cover to the tilt jamb liner.

2. The device of claim 1 wherein the means for removably attaching the tilt jamb liner weatherstripping cover to the tilt jamb liner comprises a flexible clip on the inner face of the tilt jamb liner weatherstripping cover, the flexible clip capable of engaging and disengaging the jamb liner slot with a snap fit.

3. The device of claim 2 wherein the flexible clip comprises a double key way clip running the entire length of the tilt jamb liner weatherstripping cover, each side of the double key way clip having a curved elongated flexible member capable of bending inwardly to slip past one edge of the jamb liner slot and capable snapping back to engage the one edge of the jamb liner slot to secure the jamb liner weatherstripping cover in place with a snap fit, and further capable of bending inwardly to slip past one edge of the jamb liner slot upon being pulled away from the jamb liner slot for removal.

4. The device of claim 1 wherein the inner edge of the jamb liner weatherstripping cover is further provided with a weatherstripping slot in the inner edge running the length of the device and the weatherstripping means comprises a weatherstripping brush of a desired bristle length friction fit in the weatherstripping slot, the weatherstripping brush being capable of pressing against the sash to form a seal and the weatherstripping brush being capable of removal and replacement.

5. The device of claim 1 wherein the jamb liner weatherstripping cover is equal in length to the exposed portion of a lower sash and is capable of contacting the exposed portion of the lower sash and sealing it while a bottom end of the jamb liner weatherstripping cover is capable of resting on a bottom of the window frame and a top end of the jamb liner is capable of supporting an upper sash pressed firmly against the top of the window frame in a sealed relationship.

6. The device of claim 5 further comprising a resilient weatherstripping means attached to the top of the jamb liner weatherstripping cover in a sealed relationship, between the upper sash and the jamb liner weatherstripping cover, against air and water infiltration.

7. The device of claim 1 wherein the outer face of the jamb liner weatherstripping cover is a smooth surface capable of resisting mold.

8. The device of claim 7 wherein the outer face of the jamb liner weatherstripping cover is capable of being painted.

9. The device of claim 1 wherein the tilt jamb liner is provided with a protruding tab along an outer side and the outer edge of the tilt jamb liner weatherstripping cover is provided with a straight edge capable of engaging and sealing against the protruding tab.

10. The device of claim 1 wherein the tilt jamb liner is provided with a recessed slit along an inner side edge and the device further comprises a T-shaped back rail capable of being inserted in the recessed slit in a sealed relationship.

11. The device of claim 1 wherein the jamb liner weatherstripping cover is fabricated of a weather-resistant plastic.

12. The device of claim 11 wherein the jamb liner weatherstripping cover is extruded plastic.

13. The device of claim 11 wherein the jamb liner weatherstripping cover is molded plastic.

14. The device of claim 10 wherein the recessed slit is provided with a protruding lip along its opening and the T-shaped back rail is provided with a mating protruding lip along its length so that the protruding lips engage for a sealed snap fit.

* * * * *